United States Patent [19]

Kowalski

[11] 4,010,914

[45] Mar. 8, 1977

[54] PRIMER CORD DISPENSER

[76] Inventor: Leon Kowalski, Box 213, Snow Lake, Manitoba, Canada

[22] Filed: May 28, 1975

[21] Appl. No.: 581,488

[30] Foreign Application Priority Data

June 17, 1974 Canada ..... 202642

[52] U.S. Cl. ..... 242/129.62; 242/137.1; 248/158

[51] Int. Cl.[2] ..... B65H 49/00

[58] Field of Search ..... 242/86.2, 86.4, 129, 242/129.5, 129.62, 105, 128, 137.1–139; 248/24, 158; 33/127

[56] References Cited

UNITED STATES PATENTS

| | | | |
|---|---|---|---|
| 2,109,379 | 12/1938 | Brown | 33/127 |
| 2,141,248 | 12/1938 | McGurrach | 242/55.3 |
| 2,564,539 | 8/1951 | Lucan | 242/55.3 |
| 2,841,343 | 7/1958 | Dorman | 242/129.6 |
| 3,027,003 | 3/1962 | Cole et al. | 242/137.1 |
| 3,593,943 | 7/1971 | Collman | 242/129 |

FOREIGN PATENTS OR APPLICATIONS

| | | | |
|---|---|---|---|
| 1,953,650 | 6/1970 | Germany | 248/158 |

*Primary Examiner*—Leonard D. Christian
*Attorney, Agent, or Firm*—Stanley G. Ade

[57] ABSTRACT

Detonating primer cords for explosives are usually stored and dispensed from a reel sometimes contained in a cardboard box or the like. The present dispenser or container receives the reel upon a spindle and is mounted for free rotation upon a base support. The cord feeds through an aperture in the front wall of the container so that when the cord is pulled to dispense same, the container pivots upon the base so that the cord can be pulled out readily and easily. The dispenser is made of non-ferrous material to prevent electrical sparking from occuring thus adding to the safety of the dispenser.

8 Claims, 4 Drawing Figures

PRIMER CORD DISPENSER

BACKGROUND OF THE INVENTION

This invention relates to new and useful improvements in means for dispensing primer cords or the like. Priming or detonating cord used for explosives is normally wound upon a reel which in turn is contained within a cardboard box and it is usual for the top of the box to be removed and the cord to be pulled from the box. It will of course be appreciated that the reel will not rotate readily so that dispensing is difficult. Furthermore, the majority of such cord is used in rugged terrain so that the box being pulled across the ground, wears rapidly and disintegrates particularly if the ground is wet.

SUMMARY OF THE INVENTION

The present invention overcomes these disadvantages by providing a dispenser within which the reel may be mounted for free rotation. The dispenser is in turn mounted on a base so that it can pivot freely in a horizontal plane and the cord is fed through a dispensing aperture in one wall of the container. This means that when the cord is pulled to unwind the reel, the container swings around to the direction from which the cord is being pulled thus facilitating the dispensing of the cord. By manufacturing the dispenser of non-ferrous materials, inadvertent electrical sparks are eliminated thus adding to the safety of the operation.

The principal object and essence of the invention is therefore to provide a dispenser assembly within which may be mounted the conventional reel of priming cord and which then may be dispensed therefrom readily and easily.

Another object of the invention is to provide a device of the character herewithin described in which the container is mounted for free rotation upon the base so that when the cord is pulled to dispense same, the container swings around so that the dispensing aperture is in alignment with the pull being applied to the cord.

Another object of the invention is to provide a device of the character herewithin described which is preferably made of non-ferrous materials in order to prevent inadvertent sparking from occurring.

Still another object of the invention is to provide a device of the character herewithin described in which one large or a plurality of smaller conventional primer cord reels may be mounted readily and easily for dispensing rotation.

Still another object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described reference being had to the accompanying drawings in which:

DESCRIPTION OF THE DRAWINGS

In the drawings like characters of reference indicate corresponding parts in the different figures.

DETAILED DESCRIPTION

Figure 1:
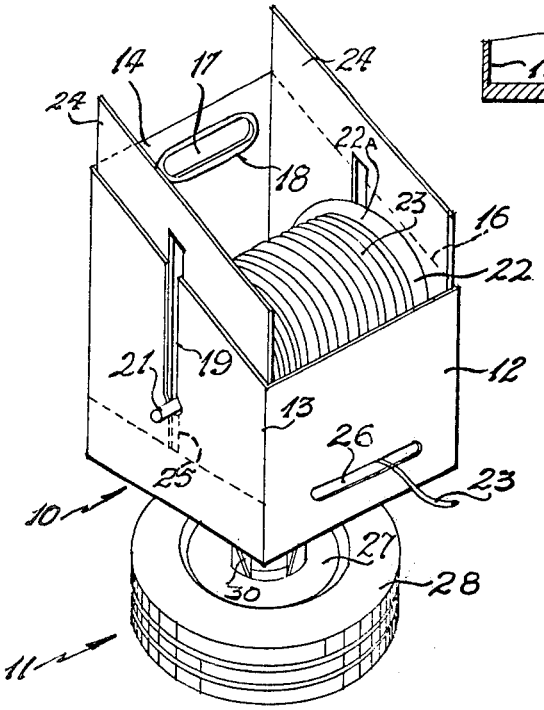
FIG. 1 is an isometric view of the device.

Proceeding therefore to describe the invention in detail, reference character 10 illustrates generally a container which is mounted upon a base generally designated 11.

The container includes a front panel 12, a pair of spaced and parallel side panels 13 and a rear panel or wall 14 which is substantially parallel to the front panel or wall 12. A base 15 extends across the lower edges of the walls of the container thus providing a substantially cubicle container which, in this embodiment, is provided with an open upper side.

The upper edges 16 of the side walls 13 incline upwardly and rearwardly from the front wall 12 towards the rear wall 14 and an elongated aperture 17 is formed through the portion of the rear wall 14 above the upper edge of the front wall 12 and a rubber or similar grommet 18 is engaged around the perimeter of this aperture which acts as a hand-hold for convenient lifting and transportation of the entire assembly.

Vertically situated apertures or slots 19, are formed opposite one another in each of the side walls 13 opening into the upper edges 16 thereof. The lower closed ends of these apertures or slots 19 incline forwardly as indicated at 20.

A wooden or plastic spindle or dowel 21 engages within these slots at the open upper ends thereof and slides downwardly to be retained by gravity within the aforementioned lower closed ends 20 of the slots. An associated reel 22 upon which detonating priming cord 23 is usually wound may be mounted upon the spindle 21 prior to engaging same within the slots 19 so that when engaged as shown in FIG. 1, the reel is mounted for free rotation upon the spindle and within the enclosure 10. The conventional reel includes a pair of end plates 22A, and a central, hollow core (not illustrated).

Alternatively a pair of smaller reels (not illustrated) may be mounted upon the spindle 21. Usually the overall width of a pair of smaller reels is greater than the width of one large reel 22. So that when one large reel 22 is used, a pair of spacer side plates 24 is engaged, one at each end of the reel 22, in order to prevent undesirable side play. These spacer plates are slotted with the base edge as at 25 to enable them to engage over the spindle 21.

This reel or reels is mounted upon the spindle 21 within the container 10 and the end of the primer cord 23 is fed through an elongated dispensing aperture 26 situated in the front panel or wall 12 of the container as clearly shown in FIG. 1.

This aperture is situated so that the primer cord feeds readily and easily from the dispenser when it is pulled with the reel rotating freely upon the spindle 21. The elongated aperture or slot 26, permits one or more cords to be dispensed at the same time if one or more reels are mounted upon spindle 21.

Means are provided to mount the container 10 upon the base 11. The base 11, in this embodiment, takes the form of a cylindrical hub component 27 surrounded by a resilient or flexible rubber tire 28 although other material can of course be used. The dimensions of the tire 28 are such that when it rests upon the ground or a supporting surface, the hub 27 is raised clear of the ground and the side of the tire acts as an anti-friction device which prevents the dispenser from being pulled along the ground by the cord 23 when it is being dispensed. Furthermore, the tire 28 insulates the container from the ground and assists in preventing any inadvertent electrical sparking from occurring.

Figure 4:
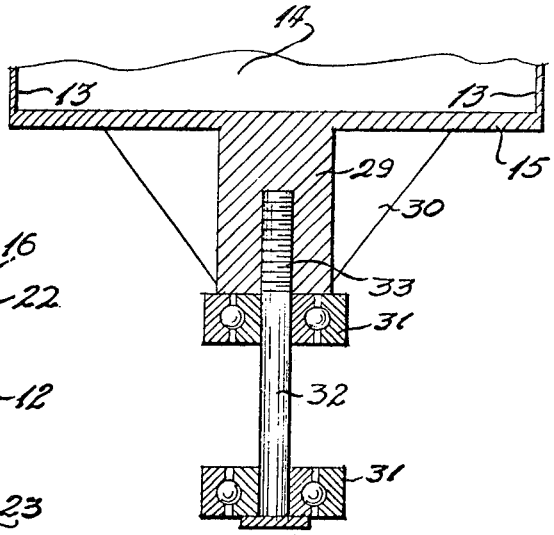
FIG. 4 is an enlarged fragmentary cross sectional view of the means mounting the container upon the base.
Figure 2:
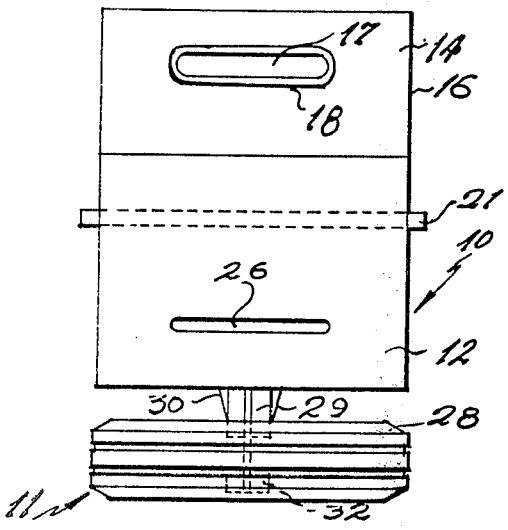
FIG. 2 is a front elevation thereof.
Figure 3:
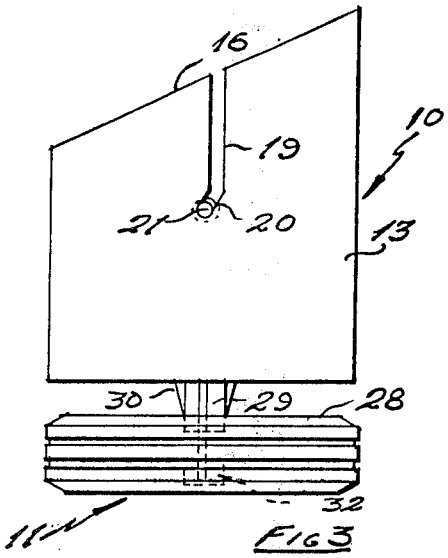
FIG. 3 is a side elevation of FIG. 2.

A cylindrical support 29 is secured centrally to the base 15 of the container and extends downwardly therefrom being braced by flanges 30 extending between the base and support as shown in FIG. 4.

A pair of spaced and parallel bearing assemblies 31 are mounted within the cylindrical hub component 27 in the usual way, and a bolt 32 extends upwardly through the bearing assemblies and screw threadably engages within a screw threaded aperture 33 formed in the support 29 thus securing the enclosure upon the hub component for free rotation in a horizontal plane.

This means that if the primer cord 33 is pulled from the aperture 26, the container automatically pivots around so that it faces the direction of pull thus facilitating the dispensing of the primer cord. Furthermore, the tire surrounding the base assists in preventing relative movement of the dispenser when the primer cord is being dispensed.

It is desirable that the entire assembly be manufactured from non-ferrous materials so that inadvertent electrical sparking cannot occur.

The entire dispenser including the reel 22 is easily moved from one position to another and, if desired, a cover can be provided (not illustrated) in order to maintain the primer cord in a dry condition during inclement weather.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. A dispenser for explosive primer cord and the like which is wound upon a reel having a transversely extending central bore; comprising in combination a container and a base, means mounting said container upon said base for free rotation in a plane parallel to said base, detachable spindle means in said container to receive the associated reel and to mount same for free rotation upon said spindle and a cord dispensing aperture in one wall of said container, said container including a rear wall, a front wall, a base plate and a pair of side walls forming a substantially cubicle container and at least one selectively detachable spacer plate engaging within said enclosure between one side of the associated reel and one of said side walls of said container, said spacer plate having a substantially vertical slot extending upwardly from the lower edge of said spacer plate and terminating spaced from the upper edge of said spacer plate, said slot engaging said spacer plate over said detachable spindle means, said spacer plate having a configuration similar to one of said side walls but with the upper edge of said spacer plate extending above the upper edge of said side wall when said spacer plate is engaged within said container, said spacer plate being removed by grasping said extending upper edge.

2. The dispenser according to claim 1 in which said base includes a substantially cylindrical component and a flexible tire-like rim surrounding said component and engaging the surface upon which said base rests.

3. The dispenser according to claim 1 in which said means mounting said container upon said base includes a support secured to the underside of said container and extending downwardly therefrom, bearing means in said base, and bolt means detachably connecting said bearing means to said support.

4. The dispenser according to claim 2 in which said means mounting said container upon said base includes a support secured to the underside of said container and extending downwardly therefrom, bearing means in said base, and bolt means detachably connecting said bearing means to said support.

5. The dispenser according to claim 1 in which said side walls include means to detachably mount said spindle means across said enclosure, said means comprising a substantially vertical slot formed in each of said side walls with the upper ends of said slots opening into the upper edges of said side walls, the lower closed ends of said slots inclining forwardly and downwardly, said spindle engaging within the said lower closed ends.

6. The dispenser according to claim 2 in which said side walls include means to detachably mount said spindle means across said enclosure, said means comprising a substantially vertical slot formed in each of said side walls with the upper ends of said slots opening into the upper edges of said side walls, the lower closed ends of said slots inclining forwardly and downwardly, said spindle engaging within the said lower closed ends.

7. The dispenser according to claim 3 in which said side walls include means to detachably mount said spindle means across said enclosure, said means comprising a substantially vertical slot formed in each of said side walls with the upper ends of said slots opening into the upper edges of said side walls, the lower closed ends of said slots inclining forwardly and downwardly, said spindle engaging within the said lower closed ends.

8. The dispenser according to claim 4 in which said side walls include means to detachably mount said spindle means across said enclosure, said means comprising a substantially vertical slot formed in each of said side walls with the upper ends of said slots opening into the upper edges of said side walls, the lower closed ends of said slots inclining forwardly and downwardly, said spindle engaging within the said lower closed ends.

* * * * *